US005967702A

United States Patent [19]

Vogelzang

[11] Patent Number: 5,967,702

[45] Date of Patent: Oct. 19, 1999

[54] QUICK-RELEASE PIT PROP

[76] Inventor: Harmen Reinaldus Vogelzang, P.O. Box 6447, Dunswart, 1508, Gauteng, South Africa

[21] Appl. No.: 09/067,951

[22] Filed: Apr. 28, 1998

[51] Int. Cl.[6] ..... E21D 15/00

[52] U.S. Cl. ..... 405/290; 405/288; 248/354.1; 248/354.3

[58] Field of Search ..... 405/272, 288, 405/290, 289; 248/354.1, 354.3, 357, 634, 548, 566, 575, 530, 542, 545; 116/DIG. 34; 33/1 H, 624; 73/862.632, 862.633, 862.637, 862.638, 862.629, 818, 856, 786

[56] References Cited

U.S. PATENT DOCUMENTS

| | | | |
|---|---|---|---|
| 1,622,158 | 3/1927 | Liberty | 33/462 |
| 4,102,295 | 7/1978 | Crook, Jr. et al. | 116/DIG. 34 |
| 4,167,361 | 9/1979 | Petro et al. | 405/290 |
| 4,221,363 | 9/1980 | Jasper | 248/354.4 X |
| 4,472,883 | 9/1984 | Ortega | 73/786 X |
| 4,733,571 | 3/1988 | Ormond | 73/862.629 X |
| 4,830,347 | 5/1989 | Langshaw | 267/141 |
| 4,983,077 | 1/1991 | Sorge et al. | 405/288 |
| 5,484,130 | 1/1996 | Domanski et al. | 248/354.3 |
| 5,564,867 | 10/1996 | Domanski et al. | 405/290 |
| 5,685,082 | 11/1997 | Proulx | 33/1 H X |
| 5,720,581 | 2/1998 | Bacon et al. | 405/290 |
| 5,758,854 | 6/1998 | Shih | 248/354.3 |

FOREIGN PATENT DOCUMENTS

| | | | |
|---|---|---|---|
| 2209549 | 5/1989 | United Kingdom | 405/290 |

*Primary Examiner*—David Bagnell
*Assistant Examiner*—Jong-Suk Lee
*Attorney, Agent, or Firm*—Killworth, Gottman, Hagan & Schaeff, LLP

[57] ABSTRACT

A pit prop has two opposed ends and comprises two bearing plates located at the ends, two telescopically displaceable prop elements, a number of separate resiliently compressible rubber discs arranged adjacent each other and a tubular indicating element. The prop includes a further bearing plate with the discs being located between two bearing plates to permit yielding of the pit prop under a load. The indicating element has markings thereon to indicate the load condition of the prop. The prop includes a locking device for releasably locking the prop elements with respect to each other.

17 Claims, 2 Drawing Sheets

QUICK-RELEASE PIT PROP

BACKGROUND OF THE INVENTION

This Invention Relates to a Prop.

The invention relates particularly to a quick-release prop which can be used as a pit prop or as a prop for various other applications, the prop of the invention hereinafter being merely referred to as a pit prop.

SUMMARY OF THE INVENTION

According to a first aspect of the invention there is provided a pit prop having two opposed ends, comprising two bearing members for bearing against opposed walls to be held in a spaced relationship, with a first bearing member being located at one end of the pit prop and a second bearing member being located at the other end of the pit prop;

two elongate prop elements that are located with respect to one another to be telescopically displaceable, the prop elements having locking means for releasably locking the prop elements with respect to one another in selected positions, one of the prop elements having the first bearing member connected thereto at a free end thereof and the other prop element having a bearing plate connected thereto at an end thereof remote from said one prop element;

yielding means disposed between the second bearing member and the bearing plate, to act between them, the yielding means including a number of separate resiliently compressible disc-like elements arranged adjacent one another, the yielding means including pre-loading means for pre-loading the pit prop when it is positioned between opposed walls to be held in a spaced relationship; and load indicating means in the form of an indicating element which is connected to the first bearing member, the indicating element defining markings thereon which indicate relative positions of the indicating element, representing a load, with respect to the yielding means when the yielding means is compressed under a load, in use.

The prop elements may be in the form of an inner tubular element which is located within an outer tubular element to be telescopically displaceable therein. The disc-like elements may define central apertures therein, the yielding means including an elongate locating element which is centrally connected at one end thereof to the second bearing member and on which the disc-like elements are slidably located via their apertures.

The yielding means may include a number of non-compressible plate-like elements disposed between adjacent disc-like elements to separate the individual disc-like elements.

The indicating element may be in the form of a tubular indicating element having two ends, with one end thereof being connected to the second bearing member and the other end thereof defining a stop formation which operatively engages the bearing plate of said other prop element to maintain a predetermined maximum spacing between the bearing plate and the second bearing member to thereby allow for pre-loading of the pit prop.

The pre-loading means of the yielding means may comprise a non-compressible spacer element which is positioned to act between the disc-like elements of the yielding means to initially compress the disc-like elements for pre-loading the pit prop, and the second bearing member of the pit prop.

The spacer element may be in the form of an annular disc which is located on the locating element of the yielding means between the second bearing member and an operative uppermost disc-like element of the yielding means.

The locking means for releasably locking the inner tubular element with respect to the outer tubular element, may include nut means comprising two nut body portions which are rotatably connectable to the outer tubular element and which have an internal screw-thread formed thereon, the inner element having an external screw-thread formed thereon which is complementary to the screw-thread of the nut body portions, the nut body portions being pivotally connected to one another to be displaceable between a first position in which the internal screw-thread of the nut body portions operatively engages the external screw-thread of the inner tubular element to permit displacement of the inner tubular element with respect to the outer tubular element via engagement of the screw-threads, and a second position in which the body portions are disengaged from the inner tubular element to permit the outer and inner tubular elements to be freely displaced with respect to one another to allow for rapid adjustment of the length of the pit prop.

The locking means may include biasing means for biasing the nut body portions to the second position thereof.

The locking means may include a lever which is connectable to the nut means for displacing the nut body portions of the nut means between their first and second positions, the lever defining a cam formation which can engage at least one of the nut body portions, the cam formation having an over-centre action which permits the nut body portions to be releasably locked with respect to one another in the first position thereof.

The outer tubular element may define a flange formation which can be engaged by the nut body portions via complementary recess formations defined therein, to permit operative engagement of the outer tubular element by the nut body portions of the nut means.

According to a second aspect of the invention there is provided a pit prop having two opposed ends, comprising two bearing members for bearing against opposed walls to be held in a spaced relationship, with a first bearing member being located at one end of the pit prop and a second bearing member being located at the other end of the pit prop;

two elongate prop elements in the form of an inner tubular element and an outer tubular element within which the inner tubular element is located to be telescopically displaceable therein, one of the tubular elements having the first bearing member connected thereto at a free end thereof and the other tubular element having a bearing plate connected thereto at an end thereof remote from said one tubular element;

yielding means disposed between the second bearing member and the bearing plate, to act between them, the yielding means including at least one resiliently compressible member and pre-loading means for pre-loading the pit prop when it is positioned between opposed walls to be held in a spaced relationship; and locking means for releasably locking the inner tubular element with respect to the outer tubular element, the locking means including nut means comprising two nut body portions which are rotatably connectable to the outer tubular element and which have an internal screw-thread formed thereon, the inner tubular element having an external screw-thread formed thereon which is complementary to the screw-thread of the nut body portions, the nut body portions being pivotally connected to one another to be displaceable with respect to one another between a first position in which the internal screw-thread of the nut body portions operatively engages the external screw-thread of the inner tubular element to permit displacement of the inner tubular element with respect to the outer tubular element via engagement of the screw-threads, and a second position in which the body portions are disengaged from the inner tubular element to permit the outer and inner tubular elements to be freely displaced with respect to one another to allow for adjustment of the length of the pit prop.

The locking means may include biasing means for biasing the nut body portions to the second position thereof.

The locking means may include a lever which is connectable to the nut means for displacing the nut body portions of the nut means between their first and second positions, the lever defining a cam formation which can engage at least one of the nut body portions, the cam formation having an over-centre action which permits the nut body portions to be releasably locked with respect to one another in the first position thereof.

The outer tubular element may define a flange formation which can be engaged by the nut body portions via complementary recess formations defined therein, to permit operative engagement of the outer tubular element by the nut body portions.

The yielding means may include a number of separate resiliently compressible disc-like elements arranged adjacent one another.

The yielding means may include a number of non-compressible plate-like elements disposed between each of the disc-like elements to separate the individual disc-like elements.

Further features of the pit prop of the invention, including the mode of use thereof, are described in further detail hereinafter, with reference to a non-limiting example of a pit prop as illustrated in the accompanying diagrammatic drawings. In the drawings:

A BRIEF DESCRIPTION OF THE DRAWINGS

A DETAILED DESCRIPTION OF THE INVENTION

Figure 1:
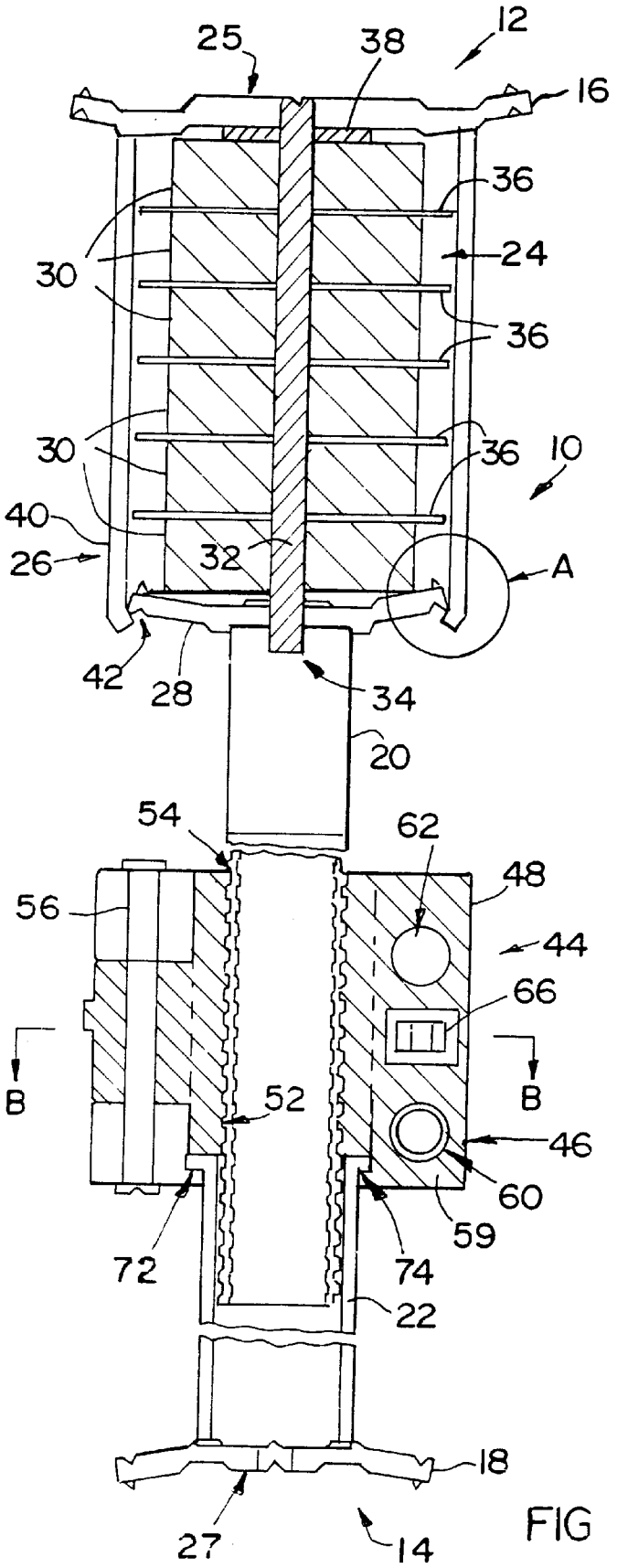
FIG. 1 shows a partially sectioned side elevation of a pit prop, in accordance with the invention.
Figure 2:
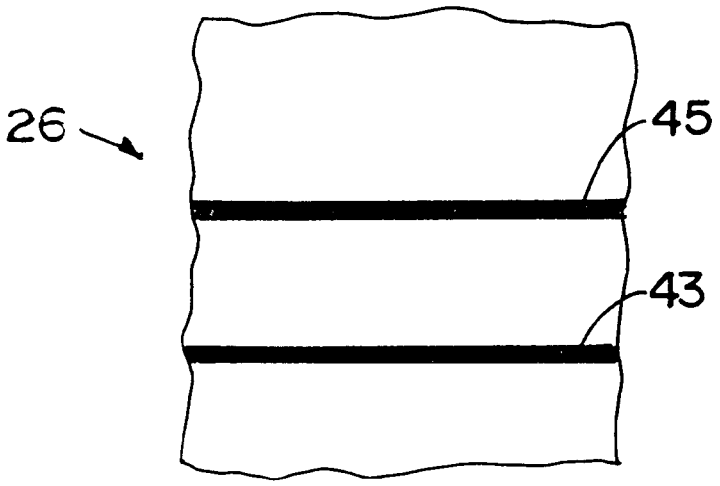
FIG. 2 shows an enlarged schematic detail view A of a tubular indicating element of the pit prop of FIG. 1.
Figure 3:
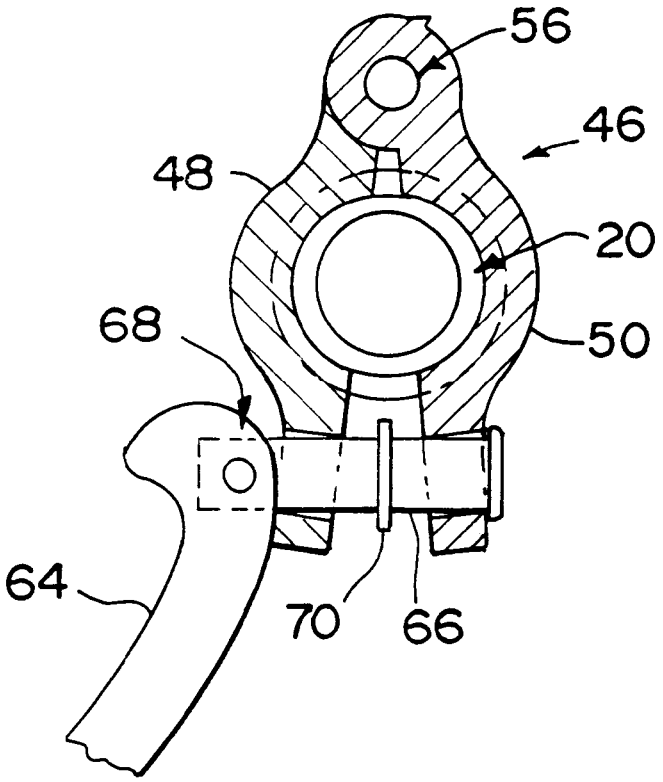
FIG. 3 shows a sectional plan view of the pit prop of FIG. 1, sectioned along section line B—B of FIG. 1.

With reference to the drawings, a pit prop, in accordance with the invention, is designated generally by the reference numeral 10. The pit prop 10 has an operative top end 12 and an opposed operative bottom end 14 and includes bearing members in the form of bearing plates 16 and 18 located at the ends 12 and 14, respectively, of the pit prop 10, two telescopically displaceable prop elements in the form of an inner tubular element 20 which is located within an outer tubular element 22, yielding means 24 and load indicating means 26.

The bearing plates 16 and 18 define bearing surfaces 25 and 27 respectively, thereon for bearing against opposed walls to be held in a spaced relationship, for example a floor wall and a roof wall in a mine working.

The yielding means 24 is disposed between the bearing plate 16 and a bearing plate 28 which is connected to the inner tubular element 20, at its operative top end. The yielding means 24 includes a number of separate resiliently compressible rubber discs 30 which are arranged on top of one another, and acts between the bearing plate 16 and the bearing plate 28. The discs 30 define central apertures therein and the yielding means 24 includes an elongate locating element in the form of a locating rod 32 which is centrally connected to the bearing plate 16 at one end of the rod 32 and operatively depends downwardly therefrom. As such, the bearing plate 28 defines a central aperture therein in which the locating rod 32 is displaceably located to permit operative axial displacement of the locating rod 32 therein. Accordingly, an operative lower end 34 of the locating rod 32 is located within the inner tubular element 24.

The yielding means 24 includes a number of metal plates 36 which are disposed between adjacent rubber discs 30 to thereby separate the discs 30 from one another.

In use, when bearing a load, the rubber discs 30 of the pit prop 10 are operatively compressed in an axial direction, thereby allowing for yielding of the pit prop 10 in order to avoid rock bursts which can occur due to excessive pressure being built up on the pit prop 10. Further, by separating the individual rubber discs 30 by the plates 36, yielding is permitted to occur in a uniform manner.

The yielding means 24 includes pre-loading means for pre-loading the pit prop 10 when it is positioned between a floor wall and a roof wall in a mine working. As such the pre-loading means comprises a spacer element in the form of a washer 38 which is positioned to act on the rubber discs 30 to initially compress them for pre-loading the pit prop 10, and the bearing plate 16. The washer 38 defines a central aperture therethrough, thereby permitting it to be centrally located on the locating rod 32. In particular, the washer 38 operatively penetrates the uppermost rubber disc 30 when the pit prop 10 is pre-loaded, the load indicating means 26 as described hereafter indicating the extent of pre-loading and permitting pre-loading to take place.

The load indicating means 26 is in the form of a tubular indicating element 40 which is connected to the bearing plate 16 and which surrounds and is spaced from the rubber discs 30 of the yielding means 24 when the pit prop 10 is in a pre-loaded condition. An operative lower end of the tubular indicating element 40 defines an inwardly projecting stop formation 42 which operatively engages the bearing plate 28 to maintain a predetermined maximum spacing between the bearing plate 28 and the bearing plate 16 to thereby allow for pre-loading of the pit prop via the washer 38.

The tubular indicating element 40 is operatively relatively displaceable with respect to the rubber discs 30 of the yielding means 24 and defines markings in the form of rings 43 and 45 painted on an operative inner surface thereof, at its lower end, which are indicative of relative positions, representing the pre-load and maximum load conditions of the prop, respectively. It must be appreciated that the amount of yield of the yielding means 24 is determined by the number of discs 30 used. As such, it is envisaged by the Applicant that when the discs 30 are at their maximum yield condition, the discs 30 will be deformed to take up substantially all of the space between the tubular indicating element and the discs. The maximum load corresponding to this fully yielded condition will be indicated by the ring 45 which will become visible when the maximum load condition is achieved. In this manner, adjustment of the pit prop 10 can take place until a desired pre-load condition is achieved and the tubular indicating element 40 also gives an indication of the actual loading on the pit prop 10 and serves to provide a warning should this load approach the maximum load sustainable by the pit prop 10.

The pit prop 10 includes locking means, designated generally by the reference numeral 44 for releasably locking the inner tubular element 20 with respect to the outer tubular element 22. As such, the locking means includes a nut means 46 which comprises two nut portions 48 and 50 which have an internal screw thread 52 formed thereon. Accordingly, the inner element 20 has an external screw thread 54 formed thereon which is complementary to the screw thread 52 of the nut body portions 48 and 50.

The nut body portions 48 and 50 are pivotally connected to one another via a pivot pin 56 and are pivotally displaceable between a first position in which the internal screw thread 52 of the nut body portions 48 and 50 engages the external screw thread 54 of the inner tubular element 20 to thereby permit displacement of the inner tubular element 20 with respect to the outer tubular element 22 via engagement of the screw threads, and a second position in which the nut body portions 48 and 50 are disengaged from the inner tubular element 20 to permit the outer and inner tubular elements 22 and 20, respectively, to be freely displaced with respect to one another to allow for rapid adjustment of the overall length of the pit prop 10. Accordingly, the nut body portions 48 and 50 are rotatably connected to the outer tubular element 22. The outer tubular element 22 defines a flange formation 72 which can be operatively engaged by the nut body portions 48 and 50 via complementary recess formations 74 defined therein. As such, the flange formation 72 permits the outer tubular element 22 to be operatively engaged by the nut body portions 48 and 50 of the nut means 46, in an arrangement in which rotation of the nut body portions 48 and 50 with respect to the outer tubular element 22 is permitted while axial displacement thereof, is prevented.

The locking means 44 includes a biasing means in the form of a release spring 60 which is located in opposed recess formations 59 defined in the nut body portions 48 and 50 for biassing the nut body portions 48 and 50 to the second position thereof. Further, the nut body portions 48 and 50 define a carry hole 62 therein to facilitate carrying of the pit prop 10 during transport thereof.

The locking means 44 includes a handle 64 which is pivotally connected to a locating pin 66 which is located in apertures defined in each of the nut body portions 48 and 50, which are in register with one another. As such, the handle defines a cam formation 68 which can engage the nut body portion 48 for locking and releasing the nut body portions 48 and 50 with respect to one another. The cam formation 68 particularly has an over-centre action which permits the nut body portions 48 and 50 to be releasably locked with respect to one another in the first position thereof. Further, the locating pin 66 defines a central washer 70 which prevents over-tightening of the nut body portions 48 and 50 on the inner tubular element 20 by ensuring that an appropriate spacing is maintained between the nut body portions 48 and 50.

An advantage of the pit prop of the invention is that the tubular indicating element 40 allows a person to monitor the load on the pit prop between a pre-loaded condition and a maximum load condition, thereby permitting adjustment, where necessary, or the taking of steps to alleviate the load if the maximum load of the pit prop is approached.

The Applicant believes that the pit prop of the invention provides an effective pit prop which allows for yielding under load and which gives an accurate indication of the load conditions experienced by the pit prop. The prop is also particularly suitable where quick setting up and/or quick release is required. Also, for specific requirements different design parameters may apply and the prop can thus be rendered very versatile and suitable for many different applications.

I claim:

1. A pit prop having two opposed ends, comprising two bearing members for bearing against opposed walls to be held in a spaced relationship, with a first bearing member being located at one end of the pit prop and a second bearing member being located at the other end of the pit prop;

two elongate prop elements that are located with respect to each other to be telescopically displaceable, the prop elements having locking means for releasably locking the prop elements with respect to each other in selected positions, one of the prop elements having the first bearing member connected thereto at a free end thereof and the other prop element having a bearing plate connected thereto at an end thereof remote from said one prop element;

yielding means disposed between the second bearing member and the bearing plate, to act between the second bearing member and the bearing plate, the yielding means including a number of separate resiliently compressible disc elements arranged adjacent each other, the yielding means for pre-loading means for pre-loading the pit prop when the pit prop is positioned between opposed walls to be held in a spaced relationship; and load indicating means in the form of an indicating element which is connected to the second bearing member, the indicating element defining markings thereon which indicate relative positions of the indicating element, representing a load, with respect to the yielding means when the yielding means is compressed under a load, in use.

2. The pit prop as claimed in claim 1, wherein the prop elements are in the form of an inner tubular element which is located within an outer tubular element to be telescopically displaceable therein.

3. The pit prop as claimed in claim 1, wherein the disc elements define central apertures therein, the yielding means including an elongate locating element which is centrally connected at one end thereof to the second bearing member and on which the disc elements are slidably located via the apertures of the disc elements.

4. The pit prop as claimed in claim 3, wherein the yielding means includes a number of non-compressible plate elements disposed between adjacent disc elements to separate the individual disc elements.

5. The pit prop as claimed in claim 1, wherein the indicating element is in the form of a tubular indicating element having two ends, with one end thereof being connected to the second bearing member and the other end thereof defining a stop formation which operatively engages the bearing plate of said other prop element to maintain a predetermined maximum spacing between the bearing plate and the second bearing member to thereby allow for pre-loading of the pit prop.

6. The pit prop as claimed in claim 5, wherein the pre-loading means of the yielding means comprises a non-compressible spacer element which is positioned to act between the disc elements of the yielding means and the second bearing member of the pit prop to initially compress the disc elements for pre-loading the pit prop.

7. The pit prop as claimed in claim 6, wherein the disc elements define central apertures therein, the yielding means including an elongate locating element which is centrally connected at one end thereof to the second bearing member and on which the disc elements are slidably located via the apertures of the disc elements, and wherein the spacer element is in the form of an annular disc which is located on the locating element of the yielding means between the second bearing member and an operative uppermost disc element of the yielding means.

8. The pit prop as claimed in claim 2, wherein the locking means for releasably locking the inner tubular element with respect to the outer tubular element, includes nut means comprising two nut body portions which are rotatably connectable to the outer tubular element and which have an internal screw-thread formed thereon, the inner element having which insert screw-thread formed thereon which is complementary to the screw-thread of the nut body portions, the nut body portions being pivotally connected to each other to be displaceable between a first position in which the internal screw-thread of the nut body portions operatively engages the external screw-thread of the inner tubular element to permit displacement of the inner tubular element with respect to the outer tubular element via engagement of the screw-threads, and a second position in which the nut body portions are disengaged from the inner tubular element to permit the outer and inner tubular elements to be freely displaced with respect to each other to allow for rapid adjustment of the length of the pit prop.

9. The pit prop as claimed in claim 8, wherein the locking means includes biasing means for biasing the nut body portions to the second position thereof.

10. The pit prop as claimed in claim 8, wherein the locking means includes a lever which is connectable to the nut means for displacing the nut body portions of the nut means between the first and second positions, the lever defining a cam formation which can engage at least one of the nut body portions, the cam formation having an over-centre action which permits the nut body portions to be releasably locked with respect to each other in the first position thereof.

11. The pit prop as claimed in claim 8, wherein the outer tubular element defines a flange formation which can be engaged by the nut body portions via complementary recess formations defined therein, to permit operative engagement of the outer tubular element by the nut body portions of the nut means.

12. A pit prop having two opposed ends, comprising two bearing members for bearing against opposed walls to be held in a spaced relationship, with a first bearing member being located at one end of the pit prop and a second bearing member being located at the other end of the pit prop;

two elongate prop elements in the form of an inner tubular element and an outer tubular element within which the inner tubular element is located to be telescopically displaceable therein, one of the tubular elements having the first bearing member connected thereto at a free end thereof and the other tubular element having a bearing plate connected thereto at an end thereof remote from said one tubular element;

yielding means disposed between the second bearing member and the bearing plate, to act between the second bearing member and the bearing plate, the yielding means including at least one resiliently compressible member and pre-loading means for pre-loading the pit prop when the pit prop is positioned between opposed walls to be held in a spaced relationship; and locking means for releasably locking the inner tubular element with respect to the outer tubular element, the locking means including nut means comprising two nut body portions which are rotatably connectable to the outer tubular element and which have an internal screw-thread formed thereon, the inner tubular element having an external screw-thread formed thereon which is complementary to the screw-head of the nut body portions, the nut body portions being pivotally connected to each other to be displaceable with respect to each other between a first position in which the internal screw-thread of the nut body portions operatively engages the external screw-thread of the inner tubular element to permit displacement of the inner tubular element with respect to the outer tubular element via engagement of the screw-threads, and a second position in which the body portions are disengaged from the inner tubular element to permit the outer and inner tubular elements to be freely displaced with respect to each other to allow for adjustment of the length of the pit prop.

13. The pit prop as claimed in claim 12, wherein the locking means includes biasing means for biasing the nut body portions to the second position thereof.

14. The pit prop as claimed in claim 12, wherein the locking means includes a lever which is connectable to the nut means for displacing the nut body portions of the nut means between the first and second positions, the lever defining a cam formation which can engage at least one of the nut body portions, the cam formation having an over-centre action which permits the nut body portions to be releasably locked with respect to each other in the first position thereof.

15. The pit prop as claimed in claim 12, wherein the outer tubular element defines a flange formation which can be engaged by the nut body portions via complementary recess formations defined therein, to permit operative engagement of the outer tubular element by the nut body portions.

16. The pit prop as claimed in claim 12, wherein the yielding means includes a number of separate resiliently compressible disc elements arranged adjacent each other.

17. The pit prop as claimed in claim 16, wherein the yielding means includes a number of non-compressible plate elements disposed between each of the disc elements to separate the individual disc elements.

* * * * *

UNITED STATES PATENT AND TRADEMARK OFFICE

CERTIFICATE OF CORRECTION

PATENT NO. : 5,967,702

DATED : October 19, 1999

INVENTOR(S) : Harmen Reinaldus Vogelzang

It is certified that error appears in the above-identified patent and that said Letters Patent is hereby corrected as shown below:

Claim 1, column 6, line 28, "the yielding means for pre-loading" should read - - the yielding means including pre-loading- -.

Signed and Sealed this

Fifth Day of September, 2000

*Attest:*

*Attesting Officer*

Q. TODD DICKINSON

*Director of Patents and Trademarks*